US009889501B2

(12) United States Patent
Boening et al.

(10) Patent No.: US 9,889,501 B2
(45) Date of Patent: Feb. 13, 2018

(54) METHOD FOR PRODUCING A TURBOCHARGER HOUSING

(75) Inventors: Ralf Boening, Reiffelbach (DE); Stefan Krauss, Gruenstadt (DE); Stefan Nowack, Kirchheimbolanden (DE); Friedhelm Reitz, Hatzfeld (DE); Burkhard Strieder, Battenberg/Berghofen (DE)

(73) Assignee: Continental Automotive GmbH, Hannover (DE)

( * ) Notice: Subject to any disclaimer, the term of this patent is extended or adjusted under 35 U.S.C. 154(b) by 338 days.

(21) Appl. No.: 13/878,265

(22) PCT Filed: Sep. 27, 2011

(86) PCT No.: PCT/EP2011/066738

§ 371 (c)(1),
(2), (4) Date: Jul. 2, 2013

(87) PCT Pub. No.: WO2012/045609

PCT Pub. Date: Apr. 12, 2012

(65) Prior Publication Data

US 2013/0272857 A1 Oct. 17, 2013

(30) Foreign Application Priority Data

Oct. 8, 2010 (DE) ..... 10 2010 047 952

(51) Int. Cl.

| | |
|---|---|
| ***B22C 9/02*** | (2006.01) |
| ***B22C 9/10*** | (2006.01) |
| ***B22C 9/22*** | (2006.01) |
| ***B22D 25/02*** | (2006.01) |
| ***F04D 29/40*** | (2006.01) |
| ***B22C 21/14*** | (2006.01) |
| ***F04D 29/02*** | (2006.01) |

(52) U.S. Cl.

CPC ..... *B22D 25/02* (2013.01); *B22C 9/02* (2013.01); *B22C 9/10* (2013.01); *B22C 9/22* (2013.01); *B22C 21/14* (2013.01); *F04D 29/023* (2013.01); *F04D 29/403* (2013.01); *F05D 2220/40* (2013.01); *F05D 2230/21* (2013.01)

(58) Field of Classification Search

CPC .. B22C 9/02; B22C 9/10; B22C 9/101; B22C 9/22

USPC ..... 164/15, 137

See application file for complete search history.

(56) References Cited

U.S. PATENT DOCUMENTS 2,142,889 A * 1/1939 Dostal ..... B22C 9/00 164/28
3,302,250 A * 2/1967 Flitz ..... 164/232
4,157,607 A * 6/1979 Ernest ..... 29/888.06
(Continued)

FOREIGN PATENT DOCUMENTS

DE 41 18 403 A1 12/1992
DE 44 42 453 A1 5/1996
(Continued)

*Primary Examiner* — Kevin P Kerns

(74) *Attorney, Agent, or Firm* — Laurence A. Greenberg; Werner H. Stemer; Ralph E. Locher

(57) ABSTRACT

A method produces a casting, in particular a housing of a turbocharger, wherein at least one mold part for forming the casting has a respective parting plane which is arranged at a predetermined angle with respect to the longitudinal axis of the casting, and wherein at least one core element is provided.

13 Claims, 5 Drawing Sheets

(56) References Cited

U.S. PATENT DOCUMENTS

| | | | |
|---|---|---|---|
| 5,368,457 | A | 11/1994 | Watanabe et al. |
| 6,315,520 | B1 | 11/2001 | Haje et al. |
| 6,415,846 | B1 | 7/2002 | O'Hara |
| 8,118,556 | B2 | 2/2012 | Yang et al. |
| 8,327,909 | B2 | 12/2012 | Knechten |

FOREIGN PATENT DOCUMENTS

| | | | |
|---|---|---|---|
| DE | 10 2007 031 448 | A1 | 1/2009 |
| DE | 11 2008 000 306 | T5 | 12/2009 |
| DE | 10 2008 048 761 | A1 | 3/2010 |
| JP | H07303934 | A | 11/1995 |
| JP | 2007032310 | A | 2/2007 |
| WO | 99/23359 | A1 | 5/1999 |

* cited by examiner

METHOD FOR PRODUCING A TURBOCHARGER HOUSING

BACKGROUND OF THE INVENTION

Field of the Invention:

From the prior art, it is known to produce turbocharger housings in a casting process. In this case, the construction of the casting mold is designed so that use is made of a separate oil core and water core which are located in an outer mold.

BRIEF SUMMARY OF THE INVENTION

It is the object of the present invention to provide an improved method for producing a housing, particularly a turbocharger housing or a part of a turbocharger housing.

This object is achieved by a method for producing a housing having the features of the claims.

According to this, a method for producing a casting, especially a housing of a turbocharger, is provided according to the invention, wherein at least one mold part, for forming the casting, has a parting plane in each case which is arranged at a predetermined angle to the longitudinal axis of the casting and wherein at least one core element is provided.

The method in this case has the advantage that the mold part can be reproduced in one mold half of a molding flask and the core element can be inserted in the one mold half. As a result, a casting can be produced with increased accuracy since the mold part is not split into two parts along its longitudinal axis and which are formed in each case in the two mold halves of a molding flask and then by assembly in the molding flask form the mold of the casting.

Instead of this, the mold of the casting, for example completely or for the most part completely, can be formed in one mold half of the molding flask, whereas only the feeders, for example for the most part, are arranged in the other mold half.

In addition, a method for producing a casting is provided, wherein at least one mold part and at least one first core element are provided, wherein the first core element forms at least one part of the external surface of the casting.

The method in this case has the advantage that the external surface can be produced with more complex structures or shapes since the core element subsequent to the casting can be destroyed, for example mechanically by vibrations, or the binding agent of the molding sand of the core element is destroyed by means of the heat during casting so that the core element disintegrates by itself.

Furthermore, a method for producing a casting is provided, wherein at least one mold part and at least two core elements are provided, wherein the two core elements can be located one inside the other and can be positioned in a mold half of a molding flask.

The method in this case has the advantage that as a result of this a casting can be manufactured with higher precision. In this case, the manufacturing tolerances can be reduced, in a process reliable manner, for example, to +/−0.5 mm.

Advantageous embodiments and developments of the invention can be gathered from the dependent claims and also from the description with reference to the drawings.

In one embodiment according to the invention, the casting is a housing of a turbocharger, for example a bearing housing or an impeller housing or a part of such a housing.

In a further embodiment according to the invention, the first core element is a water jacket core element. In this way, a corresponding turbocharger housing with cooling can be produced in a very simple manner, during which the cooling jacket is integrated into the housing or is formed in one piece with this.

According to a further embodiment according to the invention, provision is made for a second core element. The first core element and second core element can be located one inside the other in this case and can be positioned for example in a mold half of a molding flask. This has the advantage that a casting can be produced with higher precision.

In another embodiment according to the invention, the mold part has a parting plane which is arranged at a predetermined angle to the longitudinal axis of the casting, for example at an angle of essentially 90°, and wherein the mold part can be formed for example in one mold half of a molding flask. In this case, at least one core element can also have a parting plane which is arranged at a predetermined angle to the longitudinal axis of the casting, for example at an angle of essentially 90°. This has the advantage that the shape of the casting can be reproduced in one mold half, in contrast to castings which are of a split design along the longitudinal axis and therefore have to be formed in both mold halves of a molding flask.

In a further embodiment according to the invention, the second core element is an oil core element, for example. This has the advantage that an oil feed and oil drain can be integrated into the housing of the turbocharger for supplying bearings with lubricant.

In another embodiment, at least one core element, or both core elements, forms, or form, a part of the external geometry or external surface of the casting. This has the advantage that the external surface can be formed with more complex structures or shapes since the respective core element is destroyed for removal from the casting.

According to a further embodiment according to the invention, the construction of the mold part and of the core element, or core elements, is reproduced for the most part completely, or almost completely, in one mold half of a molding flask. As a result, a casting can be produced with higher precision, without the occurrence, moreover, of unsightly flashes in the region of the parting plane between top and bottom mold halves.

In a further embodiment according to the invention, the respective core element can be produced from molding sand and a suitable binding agent so that it can be easily destroyed again for removal. In principle, however, one core element, or a plurality of core elements, can be used, consisting of different materials, for example materials which either vaporize, melt or disintegrate in another way (e.g. polystyrol), or they are melted before the casting (e.g. wax, resins).

The invention is explained in more detail below based on the exemplary embodiments which are represented in the schematic figures of the drawings. In the drawings:

DESCRIPTION OF THE INVENTION

In all the figures, similar elements, or functionally similar elements, and devices—unless stated otherwise—have been provided with the same designations.

Figure 1:
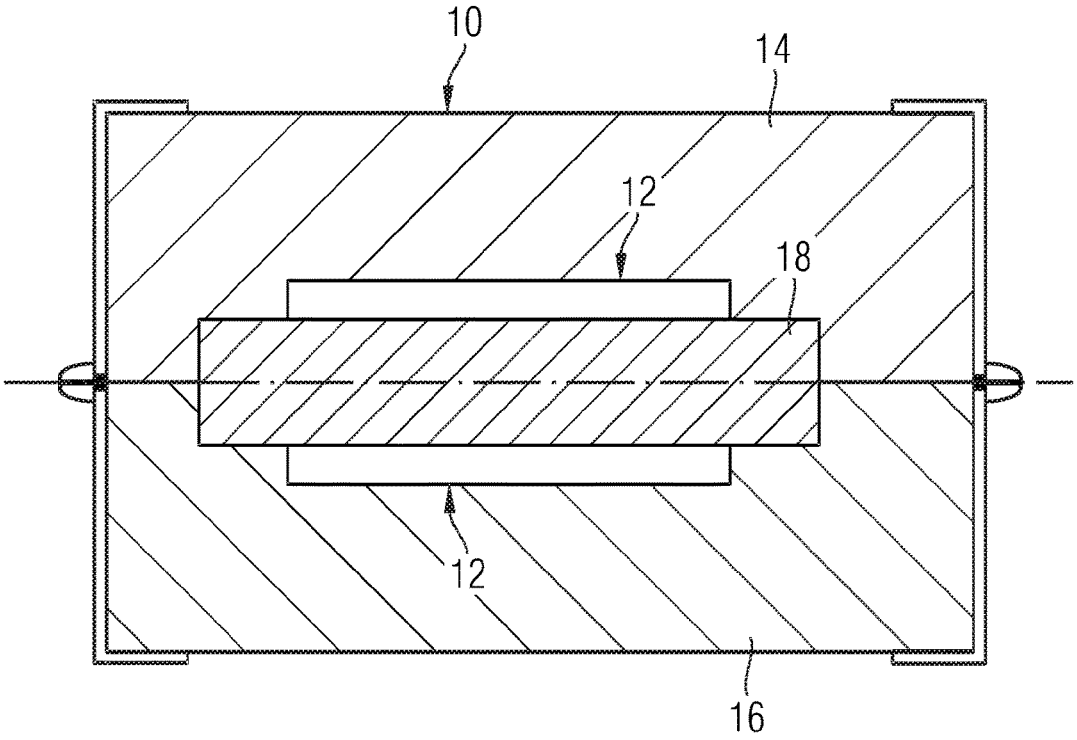
FIG 1 PRIOR ART
FIG. 1 shows a sectional view of a molding flask with an arrangement consisting of a blank and a core element according to the prior art.

A molding flask 10 for producing a blank from a cast material is first of all shown in FIG. 1. The molding flask 10 is shown in this case in greatly simplified form. The representation of feeders for feeding the liquid casting material has been dispensed with in this case for reasons of clarity. Furthermore, no mold drafts have been drawn in.

The blank or the impression 12 of the blank in the molding flask 10 is split in the longitudinal direction. This means that a cope 14 and a drag 16 of the molding flask 10 have an impression 12 of a cylinder half in each case, wherein both flasks 14, 16 in the assembled state form the complete cylindrical impression 12 of the blank.

For forming the cavity of the blank, a corresponding cylindrical core element 18 consisting of molding sand is inserted into the drag 16 in this case, as is shown in FIG. 1. The core element 18, subsequent to the casting process, after the cooling of the casting, is mechanically destroyed again, for example by vibrations, in order to thus remove it again from the finished casting.

However, there are, for example, core elements in which the binding agent of the molding sand is selected so that if possible it is destroyed by means of the heat which is created during the casting process and consequently the core element subsequently disintegrates by itself without it having to first be mechanically destroyed, as previously described.

Figure 2:
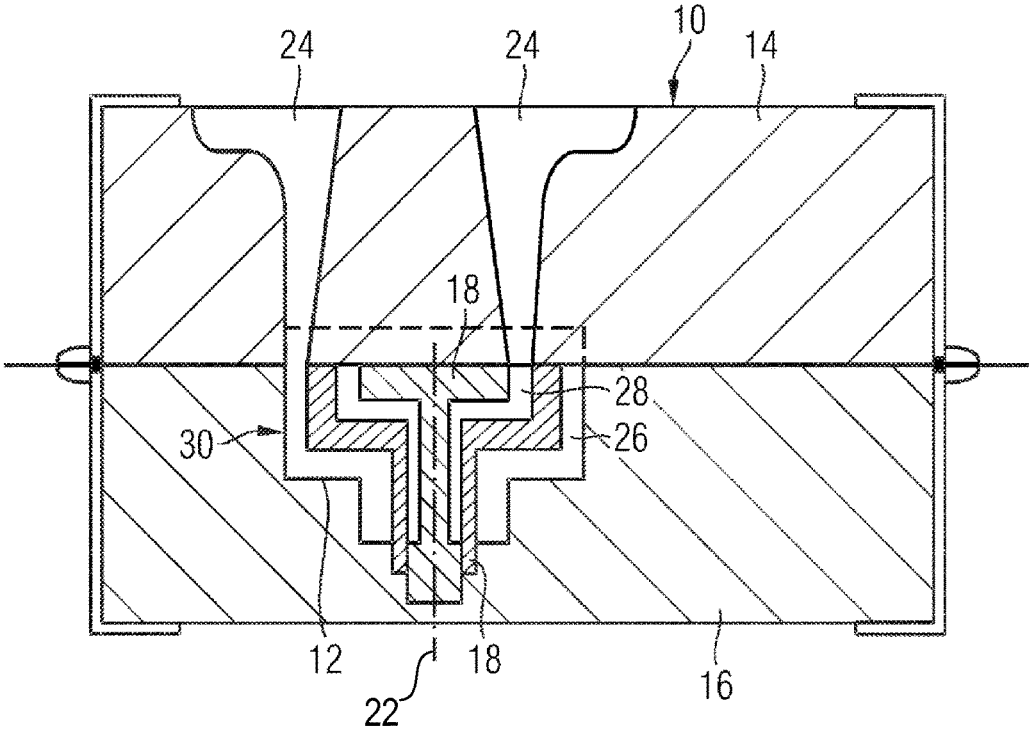
FIG. 2 shows a sectional view of a molding flask with an arrangement consisting of a blank and two core elements according to the invention.

Shown now in FIG. 2 is an exemplary embodiment for the arrangement of a blank or its mold part (pattern) and its core elements 18 in a molding flask 10 according to the invention. In contrast to the prior art, the blank or its mold part is not longitudinally split in this case, instead of this, the blank or its mold part (pattern) is formed in the drag 16, as is indicated in FIG. 2 by the impression 12 of the mold part. In this case, the mold instead of being longitudinally split can be horizontally split or split in a plane perpendicular to the longitudinal axis 22 of the blank. In this case, a mold part of the blank can be formed in the drag 16 and a mold part of the blank can also be formed in the cope 14, as is indicated in FIG. 2 by a dashed line.

Furthermore, for forming the cavities of the casting two corresponding core elements 18 are used. The liquid casting material is introduced via a feeder 24, or via a plurality of feeders, which for example are arranged in the cope 14.

The view in FIG. 2 is in this case greatly simplified and purely schematic. The shape of the core elements 18 and the impression 12 of the blank or of its mold part (pattern) are shown in a greatly simplified form and only by way of example. In this case, for example no mold drafts etc. have been shown. The same also applies for example to the shape, the arrangement and the number of feeders 24 for introducing the liquid casting material. Furthermore, the wall sections 26, 28 of the blank, which are shown in FIG. 2, are designed so that they are interconnected, which, however, is not shown in FIG. 2. The simplified view in FIG. 2 serves purely for clarification of an example for the arrangement of a mold part and corresponding core elements 18. The invention is not limited to this example.

In the example, as is shown in FIG. 2, the first core element 18 forms a first cavity of the subsequent casting. The second core element 18, moreover, forms a second cavity of the subsequent casting. The outer wall 30 of the subsequent casting in this case is formed in the present example by the impression 12 of the mold part (pattern) in the drag 16.

Figure 3:
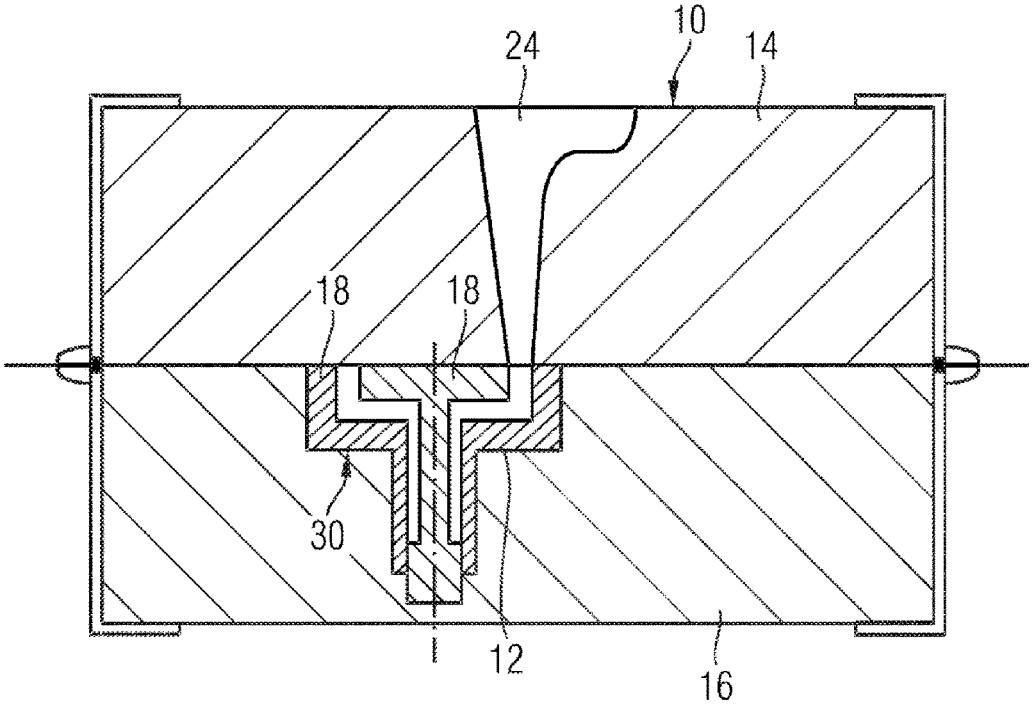
FIG. 3 shows a sectional view of a molding flask with an arrangement consisting of a blank and two core elements according to a further example of the invention.

Shown now in FIG. 3 is an exemplary embodiment for the arrangement of a blank or its mold part (pattern) and its core elements 18 in a molding flask 10 according to a further example of the invention. In this case, the impression 12 of the blank or of the mold part (pattern) is first of all formed in the molding flask 10 and then the blank or mold part is removed again. After this, a core element, or a plurality of core elements 18, for example, can be selectively arranged or positioned in the impression 12 of the mold part. In the present case, the first core element 18 is designed in such a way in this case that it can be inserted into the impression 12 of the blank or its mold part in order to form the outer wall 30 of the subsequent casting.

Whereas the first core element 18 forms the outer wall 30 of the subsequent casting, the second core element 18 in turn forms the cavity of the subsequent casting and its inner wall. The second core element 18 in this case is correspondingly inserted into the first core element 18, for example. The exemplary embodiment in FIG. 3 is also shown in a schematic and greatly simplified form like the exemplary embodiment in FIG. 2.

Figure 4:
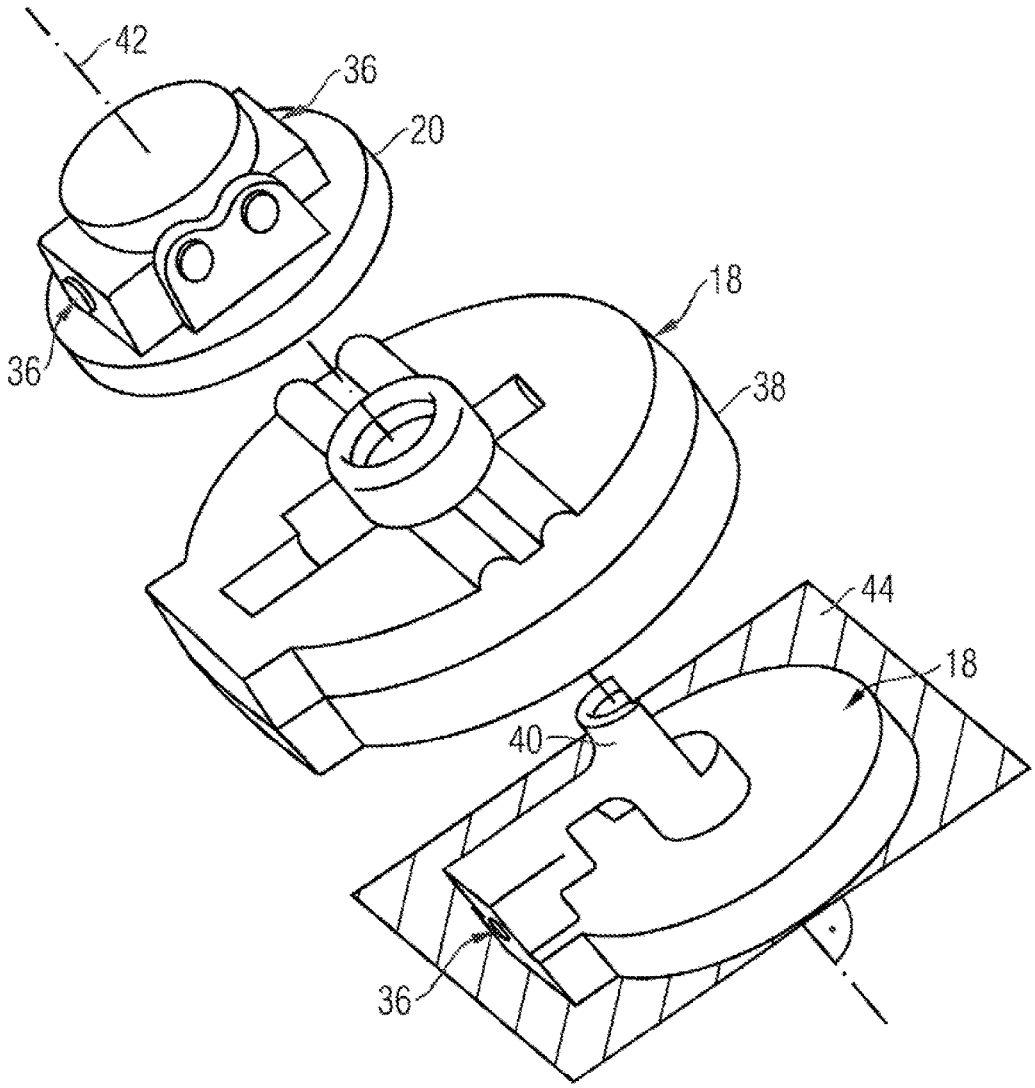
FIG. 4 shows an exploded view of a blank, and also of a water jacket core and an oil chamber core for forming a bearing housing of a turbocharger according to the invention.

Furthermore, an exploded view of a further exemplary embodiment of the invention is shown in FIG. 4. Shown in FIG. 4 in this case, as core elements 18, are the core elements 38, 40 for forming a bearing housing of a turbocharger. With this, provision is made for a blank or its mold part 20 (pattern) (FIG. 4) which in the present example (FIG. 4) is formed with an oil drain 36 and the water connection holes (of subsequent water jacket core element 38).

Furthermore, as core elements 18, provision is made for a water jacket core element 38 and also an oil chamber core element 40 for forming a water jacket around the bearing housing in order to be able to subsequently additionally cool this during operation. Furthermore, the oil chamber core element 40 is provided in order to subsequently feed a lubricant to the bearings of the bearing housing.

In contrast to the prior art, as is shown in FIG. 1, the blank or its mold part 20 (pattern) is not split in the longitudinal direction or along its longitudinal axis. Instead of this, the new design according to the invention is based on a compact mold construction. In this case, the water jacket core element 38 and the oil chamber core element 40 form a partial contour, for example, of the external geometry of the housing in each case. The respective parting planes of the mold part 20, of the water jacket core element 38 and of the oil chamber core element 40 of the bearing housing which is to be produced do not extend in this case as in the prior art in the longitudinal direction or along the longitudinal axis 42, as is shown in an example in FIG. 1, but the parting planes extend for example essentially perpendicularly to the longitudinal axis 42 of the housing which is to be produced. The parting plane 44 of the oil chamber core element 40 is indicated in this case in FIG. 4 by way of example by means of hatching. In principle, provision can also be made for at least one parting plane which is inclined by an angle which is more than or less than 90° relative the longitudinal axis 42, depending upon function and intended use.

As a result of the more compact mold construction, as is shown in FIG. 4, for example, a more precise positioning of the internal geometry in relation to the external geometry of the housing can be achieved. Initial holding points (not shown) for the mechanical machining can also be positioned on the surfaces of the external geometry which are formed by the oil chamber core element 40 and the water jacket core element 38.

Contingent upon the mold construction and core construction, a water cooled bearing housing, for example, can be geometrically completely produced by means of an oil chamber core element 40 and a water jacket core element 38, and also by means of a mold half, in this case being the drag 16. In other words, the mold of the casting which is to be produced is formed completely in the drag with the necessary core elements, as is comparably shown in the example in FIG. 3. In principle, it is also possible to form the mold of the casting which is to be produced both in the cope 14 and in the drag 16 inclusive of the necessary core elements, as is indicated by a dashed line in the example in FIG. 2.

Figure 5:
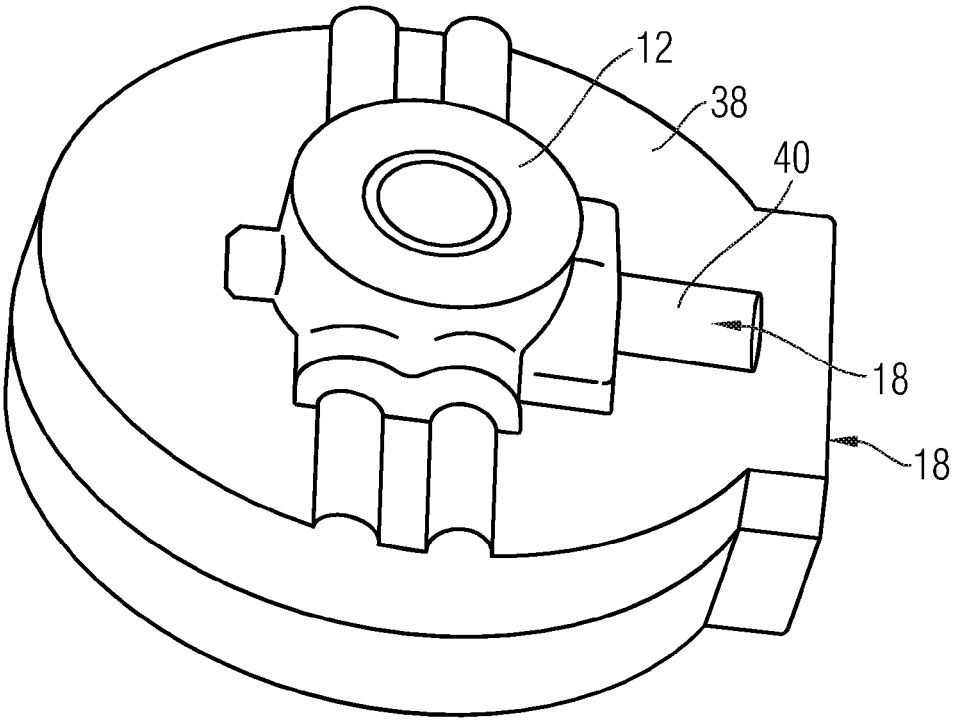
FIG. 5 shows a view of a drag side of a molding flask, wherein the blank and the water jacket core and oil chamber core according to FIG. 3 are shown in the assembled state.

As is shown in the perspective view in FIG. 5, the blank or its mold part (pattern) is first of all formed in the molding flask in order to form a corresponding impression 12, and is then removed again. A core element, or a plurality of core elements 18, for example, can be selectively inserted or positioned in the impression 12 of the blank or mold part (pattern).

The two core elements 18, i.e. the water jacket core element 38 and the oil chamber core element 40, in this case are located one inside the other, for example, (see also FIG. 6) and positioned in the drag or in this case the impression 12 of the mold part (pattern) in the drag. For reasons of clarity, the drag has been omitted in this case.

In the present case, as is shown in FIG. 5, the oil chamber core element 40 is located in the water jacket core element 38 and positioned in the drag (not shown) or the impression 12 of the mold part 20 or of the blank in the drag. This enables a massive tolerance restriction, for example in a process-reliable manner, to +/−0.5 mm in relation to the reference surface. As a result of this higher precision of the described arrangement, an increased cross-sectional area in the water passage can be made possible in a given installation space on account of the small tolerance window for the wall thicknesses between two core elements 18, 38, 40 or between an inner contour and an outer contour.

This larger cross section brings about improved heat dissipation and also enables the process-reliable removal of casting residues in the water passage and oil chamber of smaller turbocharger housings, as are used in motor vehicles, for example, on account of the better accessibility.

Figure 6:
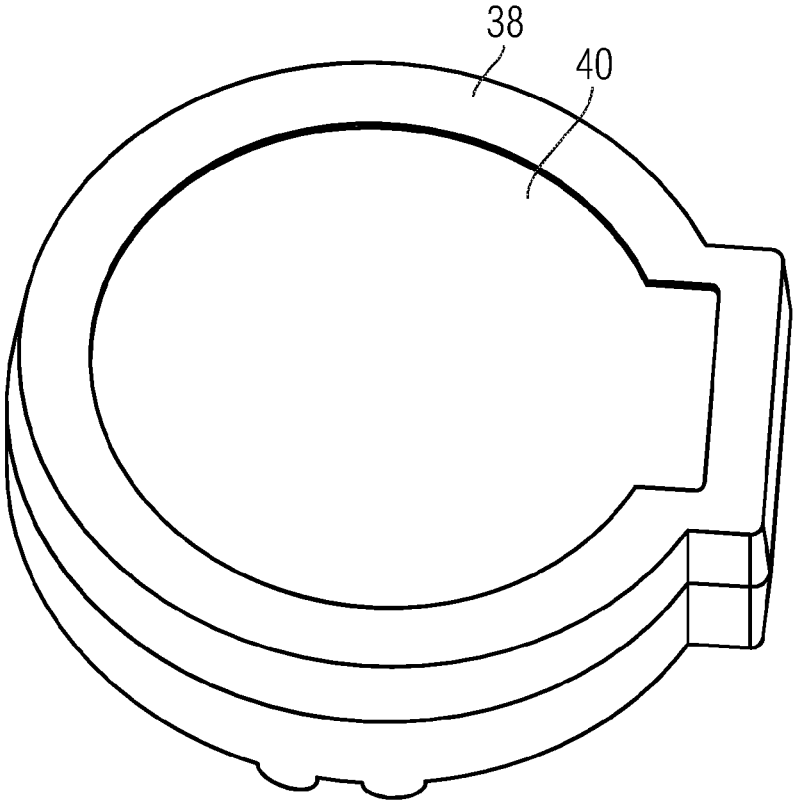
FIG. 6 shows a view of a corresponding cope side of the molding flask.

Shown in FIG. 6 is a perspective view from the direction of the cope side of the molding flask. The cope and drag have been omitted in this case also for reasons of clarity. From the greatly simplified and schematic view in FIG. 6 it can be gathered that the core elements 18 are located one inside the other, i.e. the oil chamber core element 40 is arranged or located in the water jacket core element 38.

Although the present invention was described above based on the preferred exemplary embodiments, it is not limited thereto, but can be modified in a wide variety of ways. The previously described embodiments, especially individual features thereof, can be combined with each other in this case.

According to the exemplary embodiment for producing a bearing housing it is also possible to produce a turbine housing or compressor housing, for example, in such a way. The turbine housing in this case can also be formed with a water jacket, for example, for cooling purposes. In principle, it is also possible in this case to provide a parting plane in the longitudinal direction in elements of the casting which is to be produced, as is shown by way of example in FIG. 1.

The core elements 18, 38, 40, as are shown in the exemplary embodiments in FIGS. 2 to 5, can be produced for example from sand with a suitable binding agent, as was previously described with reference to the prior art in FIG. 1. However, other materials or material combinations can also be used for producing core elements 18, 38, 40.

Furthermore, the number of core elements, their shape and arrangement, etc., and also the number of mold parts, their shape and arrangement, etc., can be optionally varied, depending upon the casting which is to be produced. The same also applies to the provision of an oil feed and/or oil drain, and also of water connection holes. This can be optionally designed and be provided or omitted depending upon requirement. For example, a turbocharger housing may be provided with, or even without, a cooling jacket, or a plurality of cooling jackets.

As casting material for the bearing housing, for example a steel casting alloy and iron casting alloy, and also their modifications, such as D5, Simo, 1.4848, 1.4849, etc., can be provided. These, however, are only examples of materials from which the housing can be produced. The invention is not limited to these materials.

The invention claimed is:

1. A casting method, comprising the steps of:

producing a casting of a turbocharger housing in a molding flask having two mold halves, the two mold halves being a cope and a drag of the molding flask, by:

providing at least one mold part having a parting plane disposed at a predetermined angle of approximately 90° to a longitudinal axis of the casting;

providing at least one first core element, the at least one first core element forming a first external surface of the casting;

providing a second core element, the at least one first core element and the second core element disposed one inside another concentrically about the longitudinal axis of the casting and positioned completely in a bottom half of the molding flask, the second core element forming a second external surface of the casting opposite the first external surface; and forming a mold of the casting completely in the drag of the molding flask and not in the cope of the molding flask, the drag of the molding flask being continuous along the longitudinal axis of the casting.

2. The method according to claim 1, wherein the first core element is a water jacket core element.

3. The method according to claim 1, wherein the first core element has a parting plane disposed at a predetermined angle to a longitudinal axis of the casting.

4. The method according to claim 3, wherein the predetermined angle is approximately 90°.

5. The method according to claim 1, wherein the second core element is an oil core element.

6. The method according to claim 1, wherein the first core element is also provided completely in the one mold half of the molding flask.

7. The method according to claim 1, which further comprises producing the first core element from molding sand and a suitable binding agent.

8. A casting method comprising the steps of:

producing a casting of a turbocharger housing in a molding flask having two mold halves, the two mold halves being a cope and a drag of the molding flask, by:

providing at least one mold part having a parting plane disposed at a predetermined angle of approximately 90° to a longitudinal axis of the casting;

forming a mold of the casting completely in the drag of the molding flask and not in the cope of the molding flask, the drag of the molding flask being continuous along the longitudinal axis of the casting; and providing at least two core elements, the two core elements being disposed one inside another concentrically about the longitudinal axis of the casting and positioned in the drag of the molding flask, at least one of the two core elements forming at least one part of an external geometry or external surface of the casting, and the two core elements being completely provided in the drag of the molding flask.

9. The method according to claim 8, wherein a first core element of the two core elements is a water jacket core element.

10. The method according to claim 8, wherein the first core element has a parting plane disposed at a predetermined angle to a longitudinal axis of the casting.

11. The method according to claim 10, wherein the predetermined angle is approximately 90°.

12. The method according to claim 8, wherein the second core element is an oil core element.

13. The method according to claim 8, which further comprises producing the at least one of the two core elements from molding sand and a suitable binding agent.

* * * * *